United States Patent [19]

Elliott et al.

[11] 4,411,817

[45] Oct. 25, 1983

[54] PRODUCTION OF SYNTHESIS GAS

[75] Inventors: James F. Elliott, Los Angeles; George N. Richter, San Marino; Lawrence E. Estabrook, Long Beach, all of Calif.

[73] Assignee: Texaco Inc., White Plains, N.Y.

[21] Appl. No.: 301,348

[22] Filed: Sep. 11, 1981

Related U.S. Application Data

[63] Continuation of Ser. No. 117,896, Feb. 1, 1980, abandoned.

[51] Int. Cl.[3] ..... C10J 3/46

[52] U.S. Cl. ..... 252/373; 48/197 R

[58] Field of Search ..... 48/197 R, DIG. 2, 206, 48/215; 252/373; 210/800, 803

[56] References Cited

U.S. PATENT DOCUMENTS

| | | | |
|---|---|---|---|
| 2,818,326 | 12/1957 | Eastman et al. | 48/215 |
| 3,018,174 | 1/1962 | Steever | 48/63 |
| 3,994,702 | 11/1976 | Schweimanns | 48/206 |
| 3,998,609 | 12/1976 | Crouch et al. | 252/373 |

*Primary Examiner*—Peter F. Kratz

*Attorney, Agent, or Firm*—Robert A. Kulason; Robert Knox, Jr.; Carl G. Seutter

[57] ABSTRACT

In a high pressure process for the production of synthesis gas from ash-containing fuels where the ash is collected in water in a settling zone below the gasification chamber, bridging by the slag in the narrower sections of the settling zone is avoided by passing a gas upwardly through the settling zone water.

11 Claims, No Drawings

PRODUCTION OF SYNTHESIS GAS

This is a continuation, of application Ser. No. 117,896, filed Feb. 1, 1980 now abandoned.

This invention is concerned with the gasification of ash-containing carbonaceous fuel by partial oxidation. More particularly, it is concerned with the production of a gas comprising carbon monoxide and hydrogen substantially free from particles of ash and unconverted fuel.

Ordinarily, in the gasification of fuels such as coal or coke, the fuel in finely-divided form is subjected to partial oxidation with air, oxygen-enriched air, or substantially pure oxygen in a gasification zone with the production of a product gas containing carbon monoxide and hydrogen and usually also containing minor amounts of carbon dioxide and methane and if the feed contains sulphur, hydrogen sulfide and carbonyl sulfide. However, since insufficient oxygen is introduced into the gasification zone for the complete combustion of the carbon in the fuel, that is, for the conversion of all of the carbon in the fuel to carbon dioxide, some of the fuel will proceed through the gasification zone without being converted to an oxide of carbon. In addition, when the feed to the gasification zone contains ash, particles of ash will also appear in the product gas. It will be appreciated that in the case of coal gasification, few of the particles are purely ash or purely carbon.

Usually, it is desirable to remove these solid particles from the product gas. For example, if the sensible heat of the product gas is to be recovered by indirect heat exchange, it is convenient to remove the solid particles from the gas prior to introducing it into a heat exchanger to prevent their collecting on the walls of the heat exchanger with subsequent interference with the flow of fluids therethrough. If the product gas is to be used for the production of hydrogen, the gas ordinarily is quenched by being introduced into water under the surface thereof in a quench zone with the solid particles being retained in the water and a substantially particle-free gas saturated with water is then subjected to shift conversion. In either instance, solid particles are collected in water and eventually some will settle to the bottom from whence they may be removed from the system. A combination of these methods is disclosed in U.S. Pat. No. 3,998,609 issued Dec. 21, 1976, the disclosure of which is incorporated herein by reference.

When the gasifier is being operated at elevated pressure, the ash particles must be removed from the system without breaking the pressure and this may be done by introducing the particles into a lock hopper and then releasing them from the system. Since the operation of the lock hopper is controlled by valves, the inlet to the lock hopper is generally of a relatively small diameter compared to the gasifier apparatus, which means that there is a section of downwardly decreasing cross sectional area immediately above the lock hopper.

Unfortunately, there are occasions when material balances show that, for the amount of feed to the gasifier and the amount of gas produced, there is a deficiency in the amount of solid particles being removed through the lock hopper. If this condition persists for a prolonged period of time, it becomes necessary to shut down the operation.

It is, therefore, an object of this invention to produce a substantially particle-free gas comprising carbon monoxide and hydrogen. Another object is to produce a synthesis gas under super-atmospheric pressure. Still another object is to enhance the removal of ash and unconverted solid fuel particles from a system for the gasification of ash-containing fuels. These and other objects will be obvious to those skilled in the art from the following disclosure.

According to our invention, there is provided a process for the gasification of an ash-containing carbonaceous fuel which comprises subjecting said fuel in finely divided form to partial oxidation in a gasification zone at superatmospheric pressure to produce a gas comprising hydrogen and carbon monoxide and containing particles of ash and unconverted fuel, collecting said particles of ash and unconverted fuel in water in a settling zone, permitting at least a portion of said ash to settle in said settling zone, introducing a gas into said settling zone to flow upwardly through the water contained therein and periodically removing settled ash from said settling zone.

The feed to the process of our invention comprises any ash-containing carbonaceous fuel such as coal, subbituminous coal, lignite, some types of coke and the like. Ordinarily, such fuel is solid although fuels which are liquid at elevated temperatures such as coal liquefaction residue may also be used. To be considered ash containing, the fuel should have an ash content of at least one weight percent. If the feed is molten at elevated temperature, it may be preheated and introduced into the gasification zone as a liquid. If, however, the fuel is solid even at elevated temperatures, then it should be ground to a particle size of less than one-fourth inch and preferably ground so that at least 95% passes through a U.S. standard 14 mesh sieve (1.41 mm. opening). The fuel is then injected into the gas generation zone where it is subjected to partial oxidation with a gas such as air, oxygen enriched air, or substantially pure oxygen, that is, oxygen having a purity of at least about 95%. The fuel may be introduced into the partial oxidation zone as a slurry in a liquid such as water or oil or as a suspension in a gaseous or vaporous medium such as steam, carbon dioxide or mixtures thereof. Water or steam may also be introduced into the gasification or partial oxidation zone as a temperature moderator. In the gas generation zone, the fuel is subjected to partial oxidation at an autogenously-maintained temperature between about 1600° and 3500° F. preferably between about 1800° and 3200° F. The pressure in the gas generation zone may range between about 100 and 3200 p.s.i.g. preferably between about 150 and 2500 p.s.i.g. The oxygen may be introduced into the gasification zone at an oxygen to carbon atomic ratio of between about 0.7 and 1.6 preferably between 0.8 and 1.2. If the fuel is solid and is introduced into the gasification zone as a slurry in water, the slurry should contain less than about 50 weight percent water as a water content above that value will affect the thermal efficiency of the reaction.

In a preferred embodiment, the reactants are fed to an unpacked gasification zone at the top thereof to flow downwardly and the product gas containing entrained solid particles is removed through a bottom outlet of the gasification chamber into contact with water.

To remove the particles of ash and/or unconverted solid fuel from entrainment in the gas, it may be contacted with water either by impinging the gas on the surface of water, e.g. maintained in a settling zone, or actually discharging the gas beneath the surface of the water. A combination of these steps is disclosed in U.S. Pat. No. 3,998,609 mentioned above. In either event, the solid particles are wetted by the water and become suspended therein. The particles of ash being more dense tend to settle to the bottom of the water in the settling zone into a lock hopper of which the upper valve is open and the lower valve is closed. In this respect, the lock hopper may be considered a portion of the settling zone. The settled ash may then be removed periodically from the system by closing the upper lock hopper valve and opening the lower valve, thus draining out water and accumulated ash particles. When the settled particles have been removed, the lower valve is closed, the lock hopper is filled with water and then the upper valve is opened. This cycle is repeated as often as the occasion demands.

Any gas not interfering with the operation of the gasification process or with any subsequent processing of the product gas may be injected into the settling zone. Examples of suitable gases are nitrogen, carbon dioxide, hydrogen and gas produced by the partial oxidation of the fuel. The gas may be introduced into the settling zone above or below the upper valve of the lock hopper and may be introduced continuously or intermittentently. In a preferred embodiment, the gas is introduced once or several times into the settling zone just below the upper valve of the lock hopper and in a still more preferred embodiment, a single introduction or the last of a series of gas introductions take place several minutes, for example, from about two to ten and preferably about five to eight minutes before the lock hopper cycle is initiated. Similarly, if the gas is introduced continuously, its introduction is terminated several minutes before the initiation of the lock hopper cycle.

The amount of gas introduced into the settling zone is not critical, but should be sufficient to create some agitation in the settling zone to prevent the formation of a bridge of slag above the upper lock hopper valve or, if a bridge has formed, to cause it to break up. The amount of gas may be determined either by the size of the settling zone or the amount of water therein. For a continuous stream of gas, a rate of about 0.5 to 5 SCF/min. per CF water in the settling zone may be used. For intermittent or in the alternative "one-shot" introduction, each introduction may amount to between about 0.5 to 20 SCF preferably 2 to 8 SCF per CF water in the settling zone. Naturally, the gas to be introduced must be at a pressure higher than that of the settling zone.

The following example is given for illustrative purposes only and it should not be construed that the invention is restricted thereto.

The ash-containing fuel in this example was an Illinois No. 6 coal having a moisture free analysis as follows:

TABLE I

| | |
|---|---|
| Carbon | 65.60 Weight % |
| Hydrogen | 4.80 Weight % |
| Nitrogen | 1.27 Weight % |
| Sulphur | 3.75 Weight % |
| Oxygen | 10.55 Weight % |
| Ash | 14.04 Weight % |

The feed, ground so that 100% passed through a 14 mesh sieve (1.41 mm opening) was injected into the upper end of an entrained flow-type gasifier as a 60.9 weight percent slurry in water. Oxygen in the form of a gas of 99.9% purity was also injected into the gasifier at the upper end at an oxygen to carbon atomic ratio of 1.05. Partial combustion of the coal took place at a temperature of 2618° F. and a pressure of 350 p.s.i.g.

In previous runs under substantially similar conditions, it was noted that the amount of ash withdrawn from the lock hopper was less than would be expected based on the amount of ash in the coal fed to the gasifier, and in some, practically no ash was withdrawn, indicating that there was some kind of hold-up in the settling zone and the run had to be terminated.

In this particular run, the lock hopper was modified by connecting to the lock hopper a small external pressure vessel which was also connected to a source of high pressure nitrogen. About five minutes before the lock hopper operation cycle was initiated, a quick opening valve between the pressure vessel and the lock hopper was opened, allowing 1.5 cubic feet of 500 psig nitrogen (5 SCF/CF water) to enter into the lock hopper and ascend through the settling zone. The quick opening valve was then closed when the pressures had equalized and after five minutes the lock hopper operation cycle was initiated.

This nitrogen purge system was used with complete success in this run and in subsequent runs when the lock hopper failed to deliver an adequate amount of solids.

Although our invention has been described in a specific example using nitrogen, other gases such as hydrogen, carbon dioxide, product gas and in some cases, steam may be used.

In one specific embodiment of the invention, the hot product gas may be passed through a waste heat boiler for the generation of high pressure steam, a portion of which may be the gas introduced into the settling zone.

In another specific embodiment, air is rectified to produce a first gas comprising nitrogen and a second gas comprising oxygen, at least a portion of said second gas is used for the partial oxidation of said carbonaceous fuel and a portion of said first gas is introduced into said settling zone.

Various modifications of the invention as herein before set forth may be made without departing from the spirit and scope thereof, and therefore, only such limitations should be made as are indicated in the appended claims.

We claim:

1. In a process for the production of synthesis gas from an ash-containing carbonaceous fuel wherein said fuel in finely divided form is subjected to partial oxidation in a gasification zone at super atmospheric pressure to produce a product comprising the gases, hydrogen and carbon monoxide, and particles of ash and unconverted fuel, and wherein said particles of ash and unconverted fuel are directed into water contained in a settling zone and in a lock hopper having a narrow valved connecting passageway therebetween, said lock hopper being located below said settling zone, and wherein said ash and unconverted fuel during settling tends to form a bridge above the valve in the connecting passageway to block the passageway and prevent the settling of said particles of ash and unconverted fuel into said lock hopper, the improved method of preventing the formation of a bridge or breaking up a bridge if one has formed which comprises introducing a gas from an external source upwardly into said connecting passageway and said settling zone at a pressure higher than that in the settling zone in order to effectively agitate the water contained therein and prevent the formation of or break up a bridge of ash and unconverted fuel particles.

2. The process of claim 1 in which the gas is introduced continuously into said connecting passageway.

3. The process of claim 1 in which the gas is introduced intermittently into said connecting passageway.

4. The process of claim 3 in which the gas is introduced into said connecting passageway between ash removal periods.

5. The process of claim 1 in which the introduced gas is product gas.

6. The process of claim 1 in which the introduced gas comprises carbon dioxide.

7. The process of claim 1 in which the introduced gas comprises hydrogen.

8. The process of claim 3 in which the gas is introduced into the connecting passageway between 2 and 10 minutes before the initiation of an ash removal cycle.

9. The process of claim 1 in which the introduced gas comprises nitrogen.

10. The process of claim 1 in which the gas is introduced into the connecting passageway from a point below the upper valve of the lock hopper.

11. The process of claim 1 in which the gas is introduced into the connecting passageway from a point above the upper valve of the lock hopper.

* * * * *